US011172277B2

(12) United States Patent
Yang

(10) Patent No.: US 11,172,277 B2
(45) Date of Patent: Nov. 9, 2021

(54) SPEAKER UNIT WITH MICROPHONE

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 16/928,012

(22) Filed: Jul. 14, 2020

(65) Prior Publication Data

US 2021/0289276 A1 Sep. 16, 2021

(30) Foreign Application Priority Data

Mar. 10, 2020 (TW) ..... 109202700

(51) Int. Cl.
*H04R 1/02* (2006.01)
*H04R 1/08* (2006.01)

(52) U.S. Cl.
CPC ..... *H04R 1/02* (2013.01); *H04R 1/08* (2013.01)

(58) Field of Classification Search
CPC ..... H04R 1/02; H04R 1/08
See application file for complete search history.

(56) References Cited

U.S. PATENT DOCUMENTS

| | | | | |
|---|---|---|---|---|
| 9,219,953 | B2 * | 12/2015 | Shimizu | H04R 1/1075 |
| 10,021,478 | B2 * | 7/2018 | Wurtz | G10K 11/17857 |
| 10,692,482 | B2 * | 6/2020 | Zhu | H04R 1/1016 |
| 10,748,522 | B2 * | 8/2020 | Yang | G10K 11/17881 |
| 10,834,492 | B2 * | 11/2020 | Feng | H04R 1/1058 |
| 2009/0141924 | A1 * | 6/2009 | Her | H04R 1/1075 381/380 |
| 2014/0211970 | A1 * | 7/2014 | Sibbald | H04R 1/1041 381/309 |
| 2021/0099786 | A1 * | 4/2021 | Sasaki | H04R 1/1075 |

FOREIGN PATENT DOCUMENTS

WO WO-2021098562 * 5/2021 ..... H04R 1/10

* cited by examiner

*Primary Examiner* — Oyesola C Ojo
(74) *Attorney, Agent, or Firm* — JCIPRNET

(57) ABSTRACT

A speaker unit with microphone is provided. The speaker unit includes a housing, a cover, a vibration element and a microphone. The cover is assembled to the housing and forms a chamber with the housing. The cover has at least one audio hole. The vibration element is disposed in the chamber for generating sound toward the cover. The microphone is fixed on the cover and outside the chamber.

12 Claims, 6 Drawing Sheets

SPEAKER UNIT WITH MICROPHONE

CROSS-REFERENCE TO RELATED APPLICATION

This application claims the priority benefit of Taiwan application serial no. 109202700, filed on Mar. 10, 2020. The entirety of the above-mentioned patent application is hereby incorporated by reference herein and made a part of this specification.

BACKGROUND

Technical Field

The disclosure is related to a speaker unit, and particularly relates to a speaker unit with microphone.

Description of Related Art

As technology continuously advances, personal electronic products tend to come with a lighter and minimized design. Smartphones, tablet computers, or laptops have all become indispensable for daily lives. No matter which of the above electronic products is in use, in order to allow users to listen to the sound information provided by electronic products without disturbing others, earphones have become an essential accessory for electronic products. Moreover, earphones also provide a better sound transmission for a listener so that the listener can clearly hear and understand the content of sound, not like the transmission of sound in the air that causes the sound to be unclear. In particular, when the user is in the condition of exercising, driving, moving vigorously or a noisy environment, the transmission of sound is also not affected. Besides, in order to make a phone call with electronic products, an earphone with microphone is also a common accessary.

To have both the functions of listening to sound and receiving sound, the traditional earphone with microphone adopts a design of separating the headset from the microphone, and the two are connected to each other by a signal line or a simple mechanism. In this way, the headset can be brought close to the ear, and the microphone can be brought close to the mouth. However, such a design leads the microphone to receive ambient noise at the same time, which greatly affects the vocal clarity of the user.

SUMMARY

The disclosure provides a speaker unit with microphone capable of improving the problem that the microphone receives ambient noise.

In the disclosure, the speaker unit with microphone includes a housing, a cover, a vibration element, and a microphone. The cover is assembled to the housing and, together with the housing, forms a chamber. The cover has at least one audio hole. The vibration element is disposed in the chamber and configured to generate sound toward the cover. The microphone is fixed on the cover and is located outside the chamber.

In an embodiment of the disclosure, the cover includes a body and an extension portion connected to each other. The body is assembled to the housing, and the extension portion extends outside the housing. The cover has a plurality of printed wirings. At least part of the printed wirings are electrically connected to the microphone and extend to the extension portion.

In an embodiment of the disclosure, the extension portion is bent to a back side of the housing opposite to the cover, and the rest of the printed wirings are electrically connected to the vibration element at the back side.

In an embodiment of the disclosure, the cover is a flexible printed circuit board formed into an integrity.

In an embodiment of the disclosure, the speaker unit with microphone further includes a hard board assembled to the housing and together with the housing forms a chamber, wherein the body of the cover is attached to the hard board.

In an embodiment of the disclosure, a material of the hard board is metal, fiberglass, plastic or bakelite.

In an embodiment of the disclosure, the speaker unit with microphone further includes a circuit board. A connector is disposed on a side of the extension portion relatively away from the body. The connector is electrically connected to the circuit board.

In an embodiment of the disclosure, a plurality of terminals are disposed at a middle section of the extension portion. The plurality of terminals are electrically connected to the vibration element.

Based on the above, in the disclosure, in the speaker unit with microphone, the microphone is located on the cover to block the ambient noise and has a good sound receiving effect.

DESCRIPTION OF THE EMBODIMENTS

Figure 1:
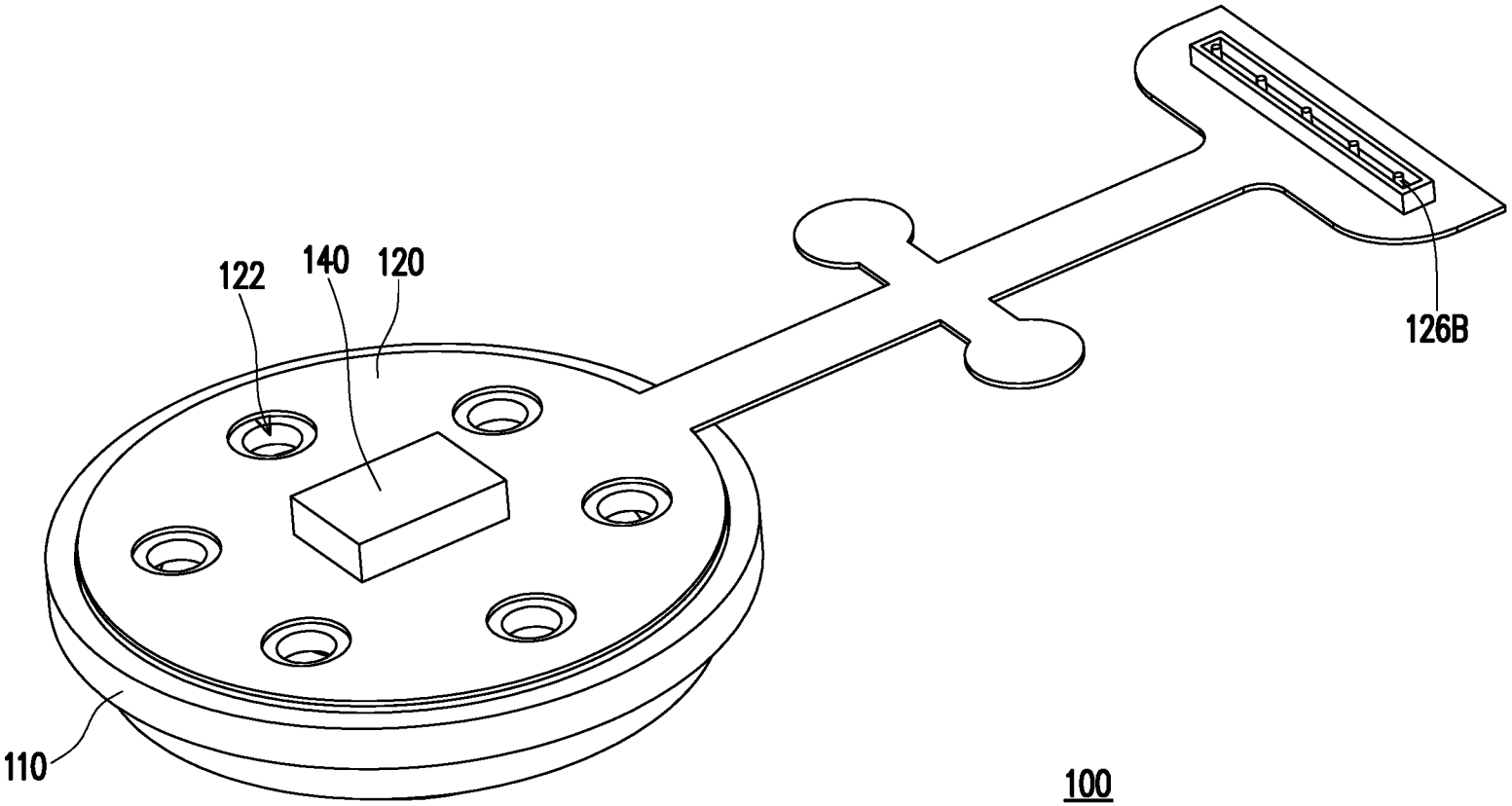
FIG. 1 is a schematic view of a speaker unit with microphone according to an embodiment of the disclosure.
Figure 2:
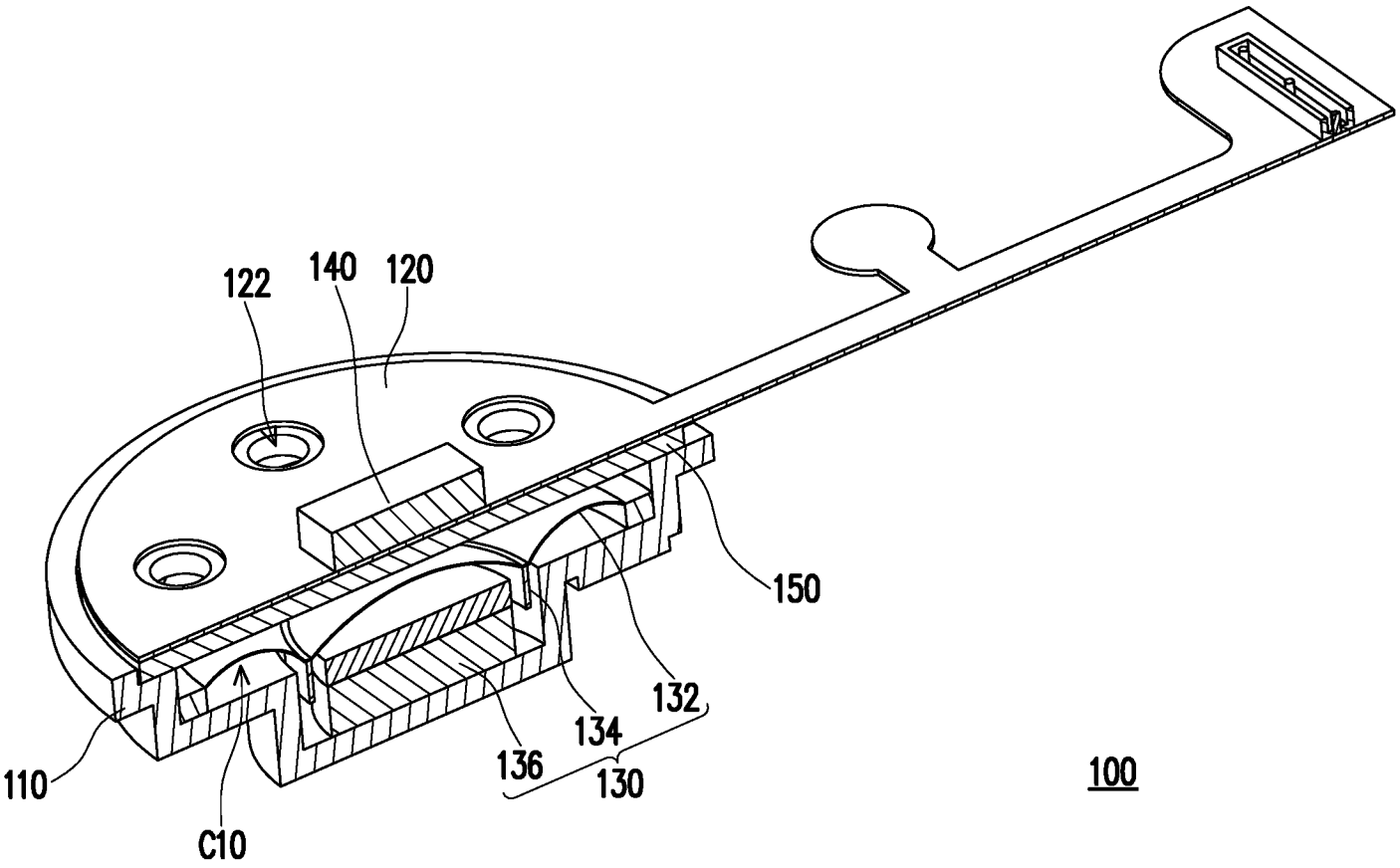
FIG. 2 is a cross-sectional view of the speaker unit of FIG. 1.

FIG. 1 is a schematic view of a speaker unit with microphone according to an embodiment of the disclosure. FIG. 2 is a cross-sectional view of the speaker unit of FIG. 1. Referring to FIG. 1 and FIG. 2, in the embodiment, a speaker unit 100 with microphone includes a housing 110, a cover 120, a vibration element 130, and a microphone 140. The cover 120 is assembled to the housing 110 and, together with the housing 110, forms a chamber C10. The cover 120 has at least one audio hole 122. The vibration element 130 is disposed in the chamber C10 for generating sound toward the cover 120. The microphone 140 is fixed on the cover 120 and is located outside the chamber C10.

In the speaker unit 100 with microphone in the embodiment, the microphone 140 is fixed on the cover 120, and the vibration element 130 is configured for generating sound toward the cover 120. In other words, when the headset of the speaker unit 100 is worn on a user's ear, the housing 110, the cover 120, and the vibration element 130 are located between the microphone 140 and the external environment, so the ambient noise received by the microphone 140 can be reduced and the microphone can have a good sound receiving effect. In addition, because the microphone 140 is directly fixed on the cover 120, there is no need to perform two manufacturing procedures to respectively fix the microphone 140 and the speaker unit 100 in the headset, thereby reducing the manufacturing procedure and also contributing to improve the assembly accuracy.

Figure 3:
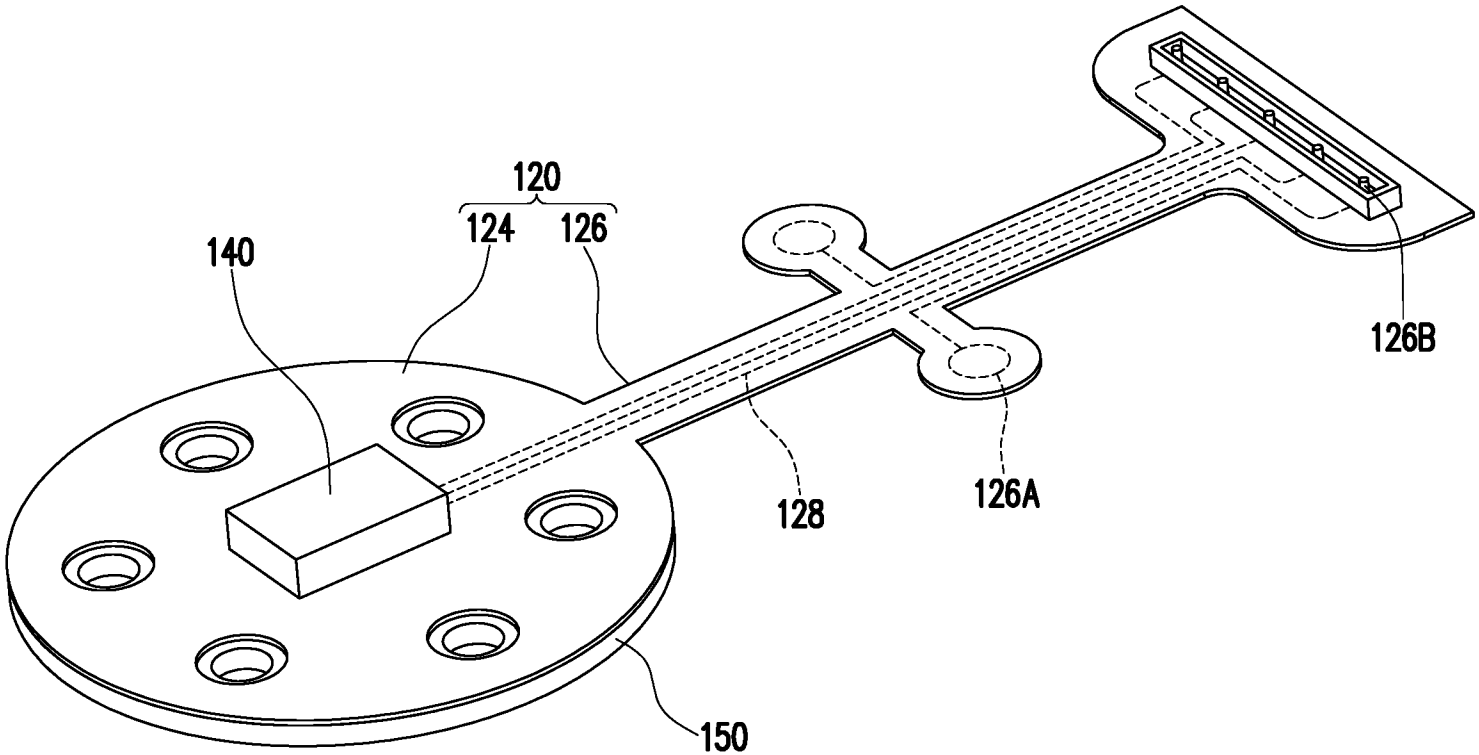
FIG. 3 is a schematic view of part of elements of the speaker unit of FIG. 1.

FIG. 3 is a schematic view of some elements of the speaker unit of FIG. 1. Referring to FIG. 2 and FIG. 3, the cover 120 in the embodiment includes a body 124 and an extension portion 126 connected to each other. The body 124 is assembled to the housing 110, and the extension portion 126 extends outside the housing 110. In other words, when the cover 120 is assembled to the housing 110, the extension portion 126 is located outside the housing 110. For example, when the opening of the housing 110 for assembling the cover 120 is substantially circular, the body 124 of the cover 120 is also substantially circular, and the extension portion 126 is similar to a tail connected to the body 124. The cover 120 further has a plurality of printed wirings 128. At least part of the printed wirings 128 is electrically connected to the microphone 140 and extends to the extension portion 126. In other words, the cover 120 is not only configured for carrying the microphone 140 and constituting the chamber C10 but also serves as a circuit carrier board so that the microphone 140 is electrically connected to the outer environment.

For example, the cover 120 may be composed of a flexible printed circuit board. In other words, the cover 120 may be a flexible printed circuit board formed into an integrity. The hardness of the body 124 of the cover 120 can also be increased accordingly. For example, an insulating material with a relatively high hardness is selected as the base of the cover 120, but the disclosure is not limited thereto.

In addition, in the embodiment, the speaker unit 100 with microphone may further include a hard board 150, which is assembled to the housing 110 and, together with the housing 110, forms the chamber C10. The body 124 of the cover 120 is attached to the hard board 150. In this way, the hard board 150 can provide the microphone 140 with a good support. In the embodiment, the material of the hard board 150 is, for example, metal, fiberglass, plastic, bakelite, or other suitable materials.

In addition, in the embodiment, the vibration element 130 includes, for example, a diaphragm 132, a coil 134, and a magnet 136. The interaction between the magnetic field generated by the current input to the coil 134 and the magnetic field of the magnet drives the diaphragm 132 to vibrate and generate sound. However, in other embodiments, the vibration element 130 may also be a balance armature or other vibration elements.

Figure 4:
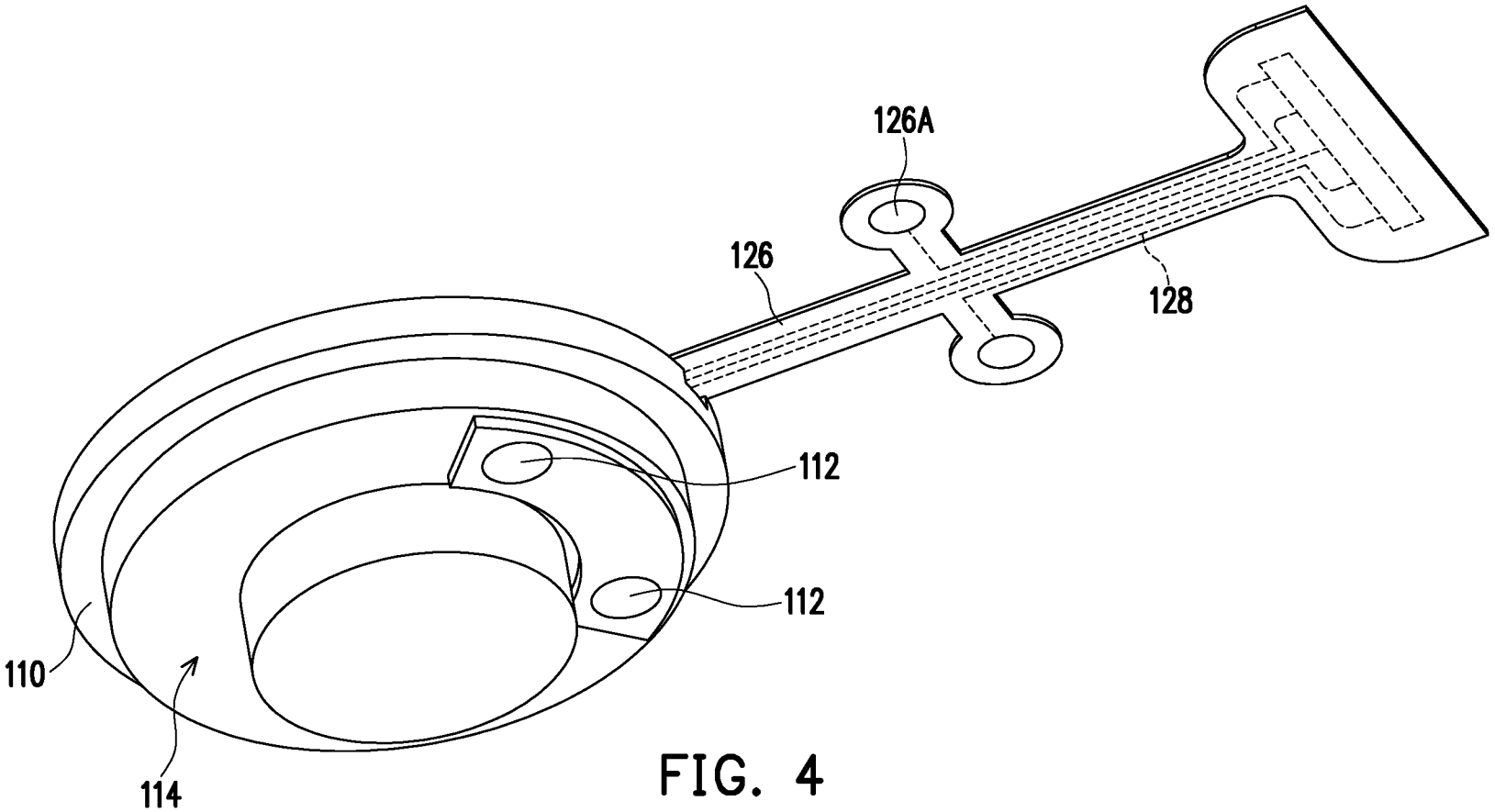
FIG. 4 is a schematic view of the speaker unit of FIG. 1 in another viewing angle.
Figure 5:
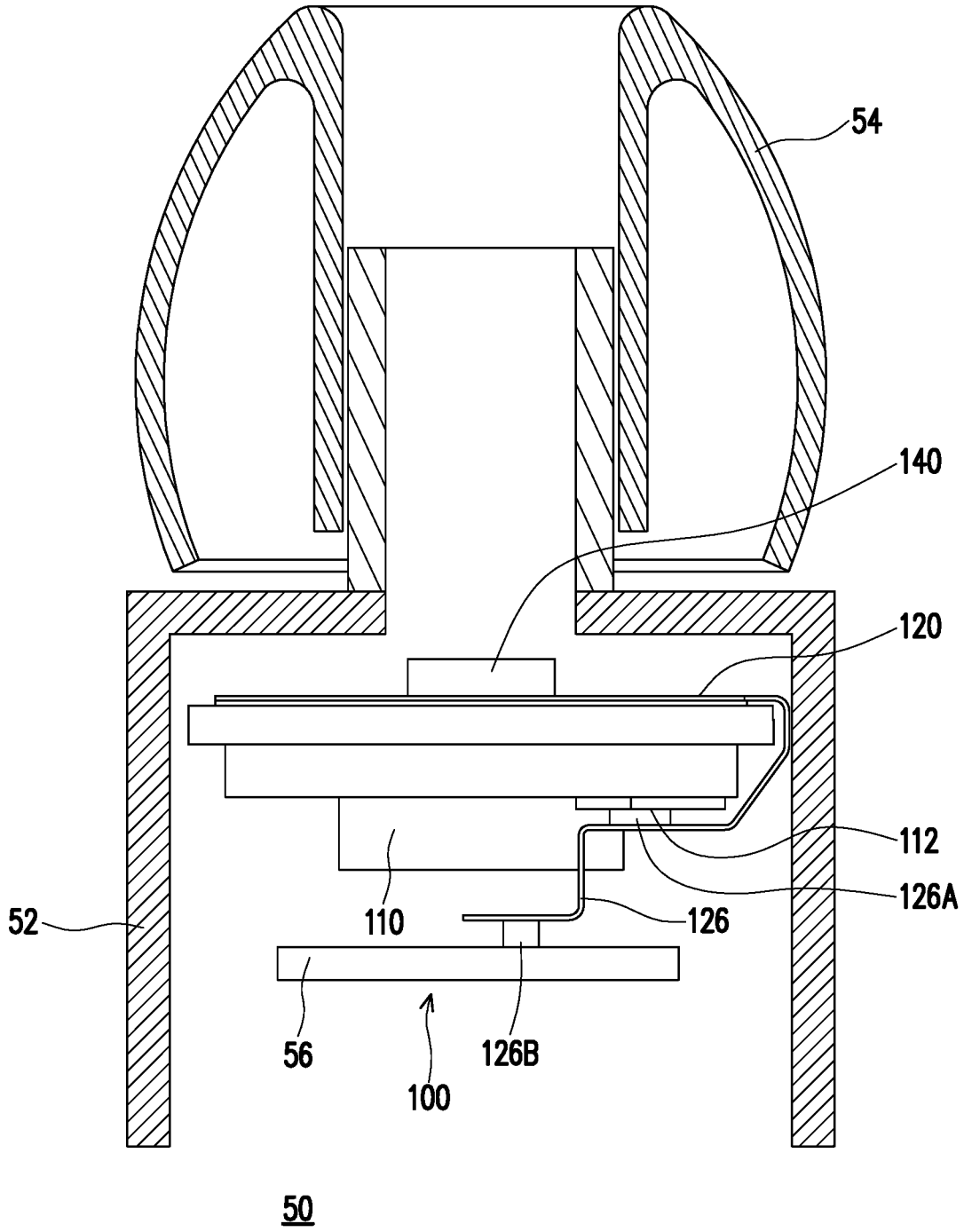
FIG. 5 is a cross-sectional view of the speaker unit of FIG. 1 when it is applied to a headset.

FIG. 4 is a schematic view of the speaker unit of FIG. 1 in another viewing angle. FIG. 5 is a cross-sectional view of the speaker unit of FIG. 1 when it is applied to a headset. Referring to FIG. 4 and FIG. 5, the bottom of the housing 110 has, for example, two terminals 112. The terminals 112 can be electrically connected to the vibration element 130 (shown in FIG. 2) for inputting and outputting signals. Correspondingly, the extension portion 126 of the cover 120 may also have two terminals 126A. In the embodiment, the middle part of the extension portion 126 is exemplified as the terminal 126A, but the disclosure is not limited thereto. When the extension portion 126 is bent to a back side 114 of the housing 110 opposite to the cover 120, the two terminals 126A can be electrically connected to the two terminals 112 of the housing 110, such that the vibration element 130 can be connected to the outside via the printed wirings 128 on the cover 120. For example, the terminal 126A and the terminal 112 may be electrically connected by welding or other methods. The types of the terminal 126A and the terminal 112 can be exposed planar pads, types with bumps, or other suitable types, and the types of the terminals in each figure are illustrated only to facilitate the understanding of their position, not to limit the types of the terminals. In addition, the terminal 126A may also be directly connected to the vibration element 130 rather than through the terminals 112 of the housing 110.

As shown in FIG. 5, when the speaker unit 100 with microphone is disposed in a headset 50, it is located in a headset housing 52, and an ear cushion 54 is disposed on a side of the headset housing 52. The microphone 140 is located between the ear cushion 54 and the housing 110. That is, the housing 110 can help reduce the ambient noise received by the microphone 140, and the microphone can have a good sound receiving effect. In addition, in the embodiment, both the vibration element 130 (shown in FIG. 2) and the microphone 140 are electrically connected to the printed wirings 128 on the cover 120 (shown in FIG. 3), and further connected to an outer electronic device via a connector 126B located on a side of the extension portion 126 of the cover 120 relatively away from the body 124. For example, the speaker unit 100 with microphone can further include a circuit board 56, and the connector 126B is electrically connected to the circuit board 56. Then, the circuit board 56 can be connected to an outer electronic device in a wired or wireless manner.

Figure 6:
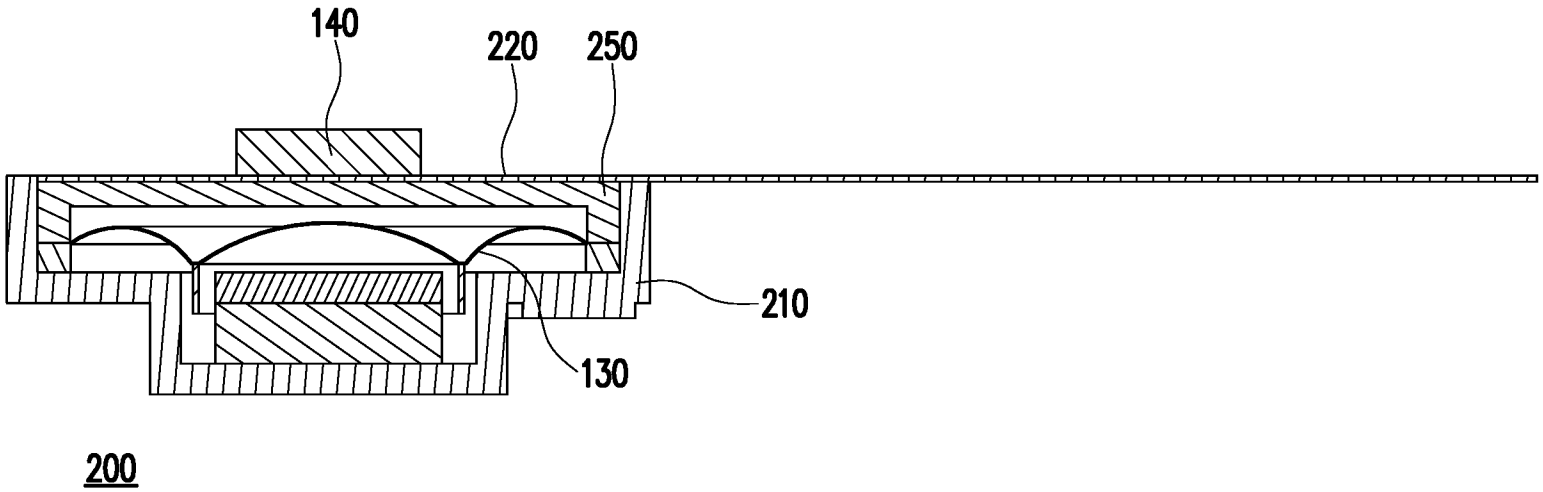
FIG. 6 is a cross-sectional view of a speaker unit with microphone according to another embodiment of the disclosure.

FIG. 6 is a cross-sectional view of a speaker unit with microphone according to another embodiment of the disclosure. Referring to FIG. 6, in the embodiment, the speaker unit 200 with microphone is similar to the speaker unit 100 with microphone of FIG. 2, and the difference between the two is the shape of the junction between a housing 210 and a hard board 250. The size of the hard board 250 in the embodiment is substantially similar to the size of the vibration element 130, so the housing 210 does not need to be expanded outward to make the size larger than the vibration element 130. In addition, the same as the previous embodiment, a cover 220 can be attached to the hard board 250 first, and then the hard board 250 is assembled to the housing 210. Alternatively, the cover 220 and the hard board 250 may be integrally formed as a single assembly. Of course, the speaker unit with microphone of the disclosure can also have a variety of appearances, which are not listed here.

Based on the above, in the speaker unit with microphone of the disclosure, the microphone is fixed on the cover, so the cover can block the ambient noise and enable the microphone to have a good sound receiving effect. In addition, the microphone can be assembled into a headset in a single manufacturing procedure when the speaker unit is assembled, thereby saving labor hours and improving assembly accuracy.

What is claimed is:

1. A speaker unit with microphone, comprising:

a housing;

a cover assembled to the housing and together with the housing forming a chamber, wherein the cover has at least one audio hole;

a vibration element disposed in the chamber and configured to generate sound toward the cover; and a microphone fixed on the cover and located outside the chamber, wherein the cover comprises a body and an extension portion connected to each other, the body is assembled to the housing, the extension portion extends outside the housing, the cover further has a plurality of printed wirings, and at least a part of the plurality of printed wirings are electrically connected to the microphone and further extends to the extension portion, wherein the extension portion is bent to a back side of the housing opposite to the cover, and the rest of the plurality of printed wirings are electrically connected to the vibration element at the back side.

2. The speaker unit with microphone of claim 1, wherein the cover is a flexible printed circuit board formed into an integrity.

3. The speaker unit with microphone of claim 2, further comprising a hard board assembled to the housing and together with the housing forming the chamber, wherein the body of the cover is attached to the hard board.

4. The speaker unit with microphone of claim 3, wherein a material of the hard board is metal, fiberglass, plastic, or bakelite.

5. A speaker unit with microphone, comprising:

a housing;

a cover assembled to the housing and together with the housing forming a chamber, wherein the cover has at least one audio hole;

a vibration element disposed in the chamber and configured to generate sound toward the cover;

a microphone fixed on the cover and located outside the chamber, wherein the cover comprises a body and an extension portion connected to each other, the body is assembled to the housing, the extension portion extends outside the housing, the cover further has a plurality of printed wirings, and at least a part of the plurality of printed wirings are electrically connected to the microphone and further extends to the extension portion; and a circuit board, wherein a connector is disposed on a side of the extension portion away from the body, and the connector is electrically connected to the circuit board.

6. A speaker unit with microphone, comprising:

a housing;

a cover assembled to the housing and together with the housing forming a chamber, wherein the cover has at least one audio hole;

a vibration element disposed in the chamber and configured to generate sound toward the cover; and a microphone fixed on the cover and located outside the chamber, wherein the cover comprises a body and an extension portion connected to each other, the body is assembled to the housing, the extension portion extends outside the housing, the cover further has a plurality of printed wirings, and at least a part of the plurality of printed wirings are electrically connected to the microphone and further extends to the extension portion, wherein a plurality of terminals are disposed at a middle section of the extension portion, and the plurality of terminals are electrically connected to the vibration element.

7. The speaker unit with microphone of claim 5, wherein the cover is a flexible printed circuit board formed into an integrity.

8. The speaker unit with microphone of claim 7, further comprising a hard board assembled to the housing and together with the housing forming the chamber, wherein the body of the cover is attached to the hard board.

9. The speaker unit with microphone of claim 8, wherein a material of the hard board is metal, fiberglass, plastic, or bakelite.

10. The speaker unit with microphone of claim 6, wherein the cover is a flexible printed circuit board formed into an integrity.

11. The speaker unit with microphone of claim 10, further comprising a hard board assembled to the housing and together with the housing forming the chamber, wherein the body of the cover is attached to the hard board.

12. The speaker unit with microphone of claim 11, wherein a material of the hard board is metal, fiberglass, plastic, or bakelite.

* * * * *